US011939642B2

(12) United States Patent
Minami et al.

(10) Patent No.: US 11,939,642 B2
(45) Date of Patent: Mar. 26, 2024

(54) HIGH-STRENGTH STEEL SHEET AND METHOD FOR MANUFACTURING SAME

(71) Applicant: JFE STEEL CORPORATION, Tokyo (JP)

(72) Inventors: Hidekazu Minami, Tokyo (JP); Yuji Tanaka, Tokyo (JP); Junya Tobata, Tokyo (JP); Takeshi Yokota, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 568 days.

(21) Appl. No.: 17/283,840

(22) PCT Filed: Aug. 20, 2019

(86) PCT No.: PCT/JP2019/032513

§ 371 (c)(1),
(2) Date: Apr. 8, 2021

(87) PCT Pub. No.: WO2020/075394

PCT Pub. Date: Apr. 16, 2020

(65) Prior Publication Data

US 2021/0381075 A1 Dec. 9, 2021

(30) Foreign Application Priority Data

Oct. 10, 2018 (JP) ..... 2018-191618

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/02*** | (2006.01) |
| ***C23C 2/06*** | (2006.01) |
| ***C23C 2/12*** | (2006.01) |
| ***C23C 2/28*** | (2006.01) |
| ***C23G 1/00*** | (2006.01) |
| ***C25D 3/22*** | (2006.01) |
| ***C25D 3/44*** | (2006.01) |

(52) U.S. Cl.

CPC ..... *C21D 9/46* (2013.01); *C21D 8/0226* (2013.01); *C21D 8/0236* (2013.01); *C21D 8/0273* (2013.01); *C22C 38/002* (2013.01); *C22C 38/02* (2013.01); *C22C 38/04* (2013.01); *C22C 38/06* (2013.01); *C23C 2/02* (2013.01); *C23C 2/0224* (2022.08); *C23C 2/024* (2022.08); *C23C 2/06* (2013.01); *C23C 2/12* (2013.01); *C23C 2/28* (2013.01); *C23G 1/00* (2013.01); *C25D 3/22* (2013.01); *C25D 3/44* (2013.01); *C21D 2211/001* (2013.01); *C21D 2211/008* (2013.01)

(58) Field of Classification Search

None

See application file for complete search history.

(56) References Cited

U.S. PATENT DOCUMENTS

| | | | |
|---|---|---|---|
| 2011/0146852 | A1 | 6/2011 | Matsuda et al. |
| 2014/0242416 | A1 | 8/2014 | Matsuda et al. |
| 2018/0010227 | A1 | 1/2018 | Ikeda et al. |
| 2019/0003007 | A1 | 1/2019 | Venkatasurya et al. |
| 2019/0218652 | A1 | 7/2019 | Haga et al. |
| 2019/0256945 | A1 | 8/2019 | Zhou et al. |

FOREIGN PATENT DOCUMENTS

| | | | |
|---|---|---|---|
| CN | 106244923 | A | 12/2016 |
| CN | 107109572 | A | 8/2017 |
| CN | 107208236 | A | 9/2017 |
| CN | 108018484 | A | 5/2018 |
| EP | 2559782 | A1 | 2/2013 |
| EP | 3128027 | A1 | 2/2017 |
| EP | 3246425 | A1 | 11/2017 |
| EP | 3257962 | A1 | 12/2017 |
| EP | 3279363 | A1 | 2/2018 |
| EP | 3508606 | A1 | 7/2019 |
| JP | 2010-90475 | A | 4/2010 |
| JP | 2010126770 | A | 6/2010 |
| JP | 2013-76148 | A | 4/2013 |

(Continued)

OTHER PUBLICATIONS

Sep. 9, 2021 Office Action issued in Chinese Patent Application No. 2019800668131.

Nov. 19, 2019 International Search Report issued in International Application No. PCT/JP2019/032513.

Aug. 18, 2021 Extended European Search Report issued in European Patent Application No. 19871124.4.

*Primary Examiner* — Anthony M Liang

(74) *Attorney, Agent, or Firm* — Oliff PLC

(57) ABSTRACT

A high-strength steel sheet having a tensile strength of 1,180 MPa or more, and specified chemical composition. The steel sheet includes a steel structure in which an area fraction of martensite having a carbon concentration of more than 0.7×[% C] and less than 1.5×[% C] is 55% or more, an area fraction of tempered martensite having a carbon concentration of 0.7×[% C] or less is 5% or more and 40% or less, a ratio of a carbon concentration in retained austenite to a volume fraction of retained austenite is 0.05 or more and 0.40 or less, and the martensite and the tempered martensite each have an average grain size of 5.3 μm or less, where [% C] represents the content, by mass %, of compositional element C in steel.

24 Claims, No Drawings

(56) References Cited

FOREIGN PATENT DOCUMENTS

| | | | | | |
|---|---|---|---|---|---|
| JP | 2015-200012 | A | | 11/2015 | |
| JP | 6172298 | B2 | | 8/2017 | |
| JP | 2018-131648 | A | | 8/2018 | |
| JP | 2018131648 | A | * | 8/2018 | ..... C21D 8/0263 |
| KR | 20130110634 | A | | 10/2013 | |
| WO | 2013/051238 | A1 | | 4/2013 | |
| WO | 2016/163468 | A1 | | 10/2016 | |
| WO | 2016/163469 | A1 | | 10/2016 | |
| WO | 2017/108966 | A1 | | 6/2017 | |
| WO | 2017/138503 | A1 | | 8/2017 | |
| WO | 2017/138504 | A1 | | 8/2017 | |
| WO | 2018/073919 | A1 | | 4/2018 | |

* cited by examiner

HIGH-STRENGTH STEEL SHEET AND METHOD FOR MANUFACTURING SAME

TECHNICAL FIELD

This application relates to a high-strength steel sheet which has a strength of 1,180 MPa or more and has excellent component dimensional accuracy, stretch-flange formability, bendability, and toughness, and a method for manufacturing the same. The high-strength steel sheet of the disclosed embodiments can be suitably used as structural members, such as automobile components.

BACKGROUND

For the purpose of achieving both reduction in $CO_2$ emissions by reducing the weight of vehicles and improvement in crashworthiness by reducing the weight of automobile bodies, strengthening of steel sheets for automobiles has advanced, and new legal restrictions have been introduced one after another. Accordingly, for the purpose of increasing the strength of automobile bodies, high-strength steel sheets having a tensile strength (TS) of 1,180 MPa grade or higher have been increasingly applied to major structural components constituting frameworks of automobile cabins.

High-strength steel sheets used for reinforcing components and frame and structural components of automobiles are required to have excellent formability. Furthermore, formed components are required to have excellent dimensional accuracy. For example, in components, such as crash boxes, since they have blanked edges and bent portions, from the viewpoint of formability, steel sheets having high stretch-flange formability and bendability are suitably used. Furthermore, from the viewpoint of component performance, by increasing the yield ratio (YR=yield strength YS/tensile strength TS) of a steel sheet, an increase in absorbed impact energy during a collision can be realized. Moreover, from the viewpoint of component dimensional accuracy, by controlling the yield ratio (YR) of a steel sheet in a specific range, springback after forming of the steel sheet can be suppressed, and component dimensional accuracy can be controlled. In order to increase the application ratio of high-strength steel sheets to automobile components, it is required to comprehensively satisfy these characteristics.

Furthermore, when high-strength steel sheets of 1,180 MPa grade or higher are used, there is a concern that toughness may be deteriorated, and therefore, the high-strength steel sheets are expected to have high toughness.

With respect to these requirements, for example, Patent Literature 1 provides a high-strength cold rolled steel sheet having excellent bendability, in addition to ductility, stretch-flange formability, and weldability, in a range in which a tensile strength is 980 MPa or more and a 0.2% yield strength is 700 MPa or more.

Patent Literature 2 provides a high-strength cold rolled steel sheet having excellent ductility and stretch-flange formability, a high yield ratio, and a tensile strength of 1,180 MPa or more; and a method for manufacturing the same.

Patent Literature 3 proposes a heat-treated steel sheet member having a tensile strength of 1.4 GPa or more and a total elongation of 8.0% or more, and excellent toughness, scale adhesion, and scale detachment; and a method for manufacturing the same.

Patent Literature 4 proposes a heat-treated steel sheet member having a tensile strength of 1.4 GPa or more and a yield ratio of 0.65 or more, and excellent toughness, scale adhesion, and scale detachment; and a method for manufacturing the same.

Patent Literature 5 provides a high-strength steel sheet having a tensile strength of 1,320 MPa or more, and excellent ductility and stretch-flange formability; and a method for manufacturing the same.

Patent Literature 6 provides a high-strength steel sheet having a tensile strength of 1,320 MPa or more, and excellent ductility, stretch-flange formability, and bendability; and a method for manufacturing the same.

CITATION LIST

Patent Literature

PTL 1: Japanese Unexamined Patent Application Publication No. 2015-200012
PTL 2: Japanese Patent No. 6172298
PTL 3: WO2016/163468
PTL 4: WO2016/163469
PTL 5: WO2017/138503
PTL 6: WO2017/138504

SUMMARY

Technical Problem

However, in the high-strength steel sheet described in each of Patent Literature 1, 2, 5, and 6, no consideration is made on toughness. Furthermore, in the heat-treated steel sheet member described in each of Patent Literature 3 and 4, no consideration is made on stretch-flange formability and bendability. As described above, there is no steel sheet that comprehensively satisfies strength, component dimensional accuracy, stretch-flange formability, bendability, and toughness.

The disclosed embodiments have been made under the circumstances described above, and it is an object of the disclosed embodiments to provide a high-strength steel sheet which has a strength of 1,180 MPa or more and has excellent component dimensional accuracy, stretch-flange formability, bendability, and toughness, and a method for manufacturing the same.

In the disclosed embodiments, the excellent component dimensional accuracy means that the yield ratio (YR), which is an indicator of component dimensional accuracy, is 65% or more and 85% or less. Note that YR can be obtained by the following formula (1):

$$YR = YS/TS \quad (1)$$

Furthermore, the excellent stretch-flange formability means that the hole expansion ratio ($\lambda$), which is an indicator of stretch-flange formability, is 30% or more.

Furthermore, the bendability was evaluated on the basis of the pass rate of a bend test. At the maximum R in which the value R/t obtained by dividing the bend radius (R) by the thickness (t) was 5 or less, five samples were subjected to the bend test. Next, the presence or absence of cracks on the ridge portion of the bend top was evaluated. In the case where all of the five samples did not crack, i.e., only in the case where the pass rate was 100%, bendability was evaluated as excellent.

Furthermore, the excellent toughness means that the brittle-ductile transition temperature obtained by a Charpy impact test is −40° C. or lower.

Solution to Problem

As a result of thorough studies conducted to solve the problem described above, the present inventors have found the followings.

(1) It is possible to achieve a stretch-flange formability of 30% or more by forming a structure mainly composed of a hard phase (martensite and tempered martensite).

(2) By setting the ratio of the carbon concentration in retained austenite to the volume fraction of retained austenite to be 0.05 or more and 0.40 or less, a YR, which is an indicator of component dimensional accuracy, of 65% or more and 85% or less can be achieved.

(3) By setting the average grain size of martensite and tempered martensite to be 5.3 μm or less, a brittle-ductile transition temperature, which is an indicator of toughness, of −40° C. or lower can be achieved.

(4) Furthermore, preferably, by setting a thickness of a surface softened layer to be 10 μm or more and 100 μm or less, bendability can be improved.

The disclosed embodiments have been made on the basis of the findings described above. That is, the gist of the disclosed embodiments is as follows.

[1] A high-strength steel sheet having a tensile strength of 1,180 MPa or more, the high-strength steel sheet having a chemical composition containing, in percent by mass, C: 0.09% or more and 0.37% or less,
Si: more than 0.70% and 2.00% or less,
Mn: 2.60% or more and 3.60% or less,
P: 0.001% or more and 0.100% or less,
S: 0.0200% or less,
Al: 0.010% or more and 1.000% or less, and
N: 0.0100% or less, with the balance being Fe and unavoidable impurities, the high-strength steel sheet having a steel structure in which an area fraction of martensite having a carbon concentration of more than 0.7×[% C] and less than 1.5×[% C] is 55% or more; an area fraction of tempered martensite having a carbon concentration of 0.7×[% C] or less is 5% or more and 40% or less; a ratio of a carbon concentration in retained austenite to a volume fraction of retained austenite is 0.05 or more and 0.40 or less; and the martensite and the tempered martensite each have an average grain size of 5.3 μm or less, where [% C] represents the content (percent by mass) of compositional element C in steel.

[2] The high-strength steel sheet according to [1], in which, in the steel structure, a thickness of a surface softened layer is 10 μm or more and 100 μm or less.

[3] The high-strength steel sheet according to [1] or [2], in which the chemical composition further contains, in percent by mass, at least one selected from the group consisting of Ti: 0.001% or more and 0.100% or less,
Nb: 0.001% or more and 0.100% or less,
V: 0.001% or more and 0.100% or less,
B: 0.0001% or more and 0.0100% or less,
Mo: 0.010% or more and 0.500% or less,
Cr: 0.01% or more and 1.00% or less,
Cu: 0.01% or more and 1.00% or less,
Ni: 0.01% or more and 0.50% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less.

[4] The high-strength steel sheet according to any one of [1] to [3], in which the high-strength steel sheet further has a coating layer on a surface thereof.

[5] A method for manufacturing the high-strength steel sheet according to any one of [1] to [3], the method including annealing a cold-rolled steel sheet obtained by performing hot rolling, pickling, and cold rolling, in which the annealing includes heating under conditions that an average heating rate in a temperature range of 250° C. or higher and 700° C. or lower is 10° C./s or more, and a heating temperature is 850° C. or higher and 950° C. or lower; and subsequently, cooling under conditions that a holding time in a temperature range of 50° C. or higher and 400° C. or lower is 70 s or more and 700 s or less, and an average cooling rate in a temperature range of 50° C. or higher and 250° C. or lower is 10.0° C./s or less.

[6] The method for manufacturing the high-strength steel sheet according to [5], in which, in the heating temperature range, an oxygen concentration is 2 ppm or more and 30 ppm or less, and a dew point is −35° C. or higher.

[7] The method for manufacturing the high-strength steel sheet according to [5] or [6], further including, after the annealing, performing coating treatment.

Advantageous Effects

According to the disclosed embodiments, it is possible to obtain a high-strength steel sheet which has a strength of 1,180 MPa or more and has excellent component dimensional accuracy, stretch-flange formability, bendability, and toughness. Furthermore, by applying the high-strength steel sheet of the disclosed embodiments, for example, to automobile structural members, fuel efficiency can be improved by weight reduction of automobile bodies. Therefore, industrial usefulness is very large.

DETAILED DESCRIPTION

Disclosed embodiments will be described below. However, the disclosure is not intended to be limited to these embodiments.

First, appropriate chemical composition ranges of a high-strength steel sheet and the limitation reasons thereof will be described. Hereinafter, "%" representing the content of each compositional element of steel means "percent by mass" unless otherwise noted.

C: 0.09% or more and 0.37% or less.

C is one of the important basic components of steel, and in particular, in the disclosed embodiments, is an important element that affects the fractions of martensite, tempered martensite, and retained austenite and the carbon concentration in retained austenite. When the C content is less than 0.09%, the fraction of martensite decreases, and it becomes difficult to achieve a TS of 1,180 MPa or more. On the other hand, when the C content exceeds 0.37%, the fraction of tempered martensite decreases, and it becomes difficult to achieve a hole expansion ratio (λ), which is an indicator of stretch-flange formability, of 30% or more. Therefore, the C content is set to be 0.09% or more and 0.37% or less. The C content is preferably 0.10% or more, preferably 0.36% or less, more preferably 0.11% or more, and more preferably 0.35% or less.

Si: more than 0.70% and 2.00% or less

Si suppresses formation of carbides during continuous annealing and promotes formation of retained austenite, and thus is an element that affects the fraction of retained austenite and the carbon concentration in retained austenite. When the Si content is 0.70% or less, retained austenite cannot be formed, and YR cannot be controlled within a desired range. On the other hand, when the Si content exceeds 2.00%, the carbon concentration in retained austenite excessively increases, and the hardness of martensite transformed from retained austenite during blanking increases greatly, resulting in an increase in void formation during blanking and hole expansion, thus decreasing λ. Therefore, the Si content is set to be more than 0.70% and 2.00% or less. The Si content is preferably 0.80% or more, preferably 1.80% or less, more preferably 0.90% or more, and more preferably 1.70% or less.

Mn: 2.60% or more and 3.60% or less

Mn is one of the important basic components of steel, and in particular, in the disclosed embodiments, is an important element that affects the fractions of martensite and tempered martensite. When the Mn content is less than 2.60%, the fraction of martensite decreases, and it becomes difficult to achieve a TS of 1,180 MPa or more. On the other hand, when the Mn content exceeds 3.60%, the fraction of tempered martensite decreases, and it becomes difficult to achieve a λ of 30% or more. Therefore, the Mn content is set to be 2.60% or more and 3.60% or less. The Mn content is preferably 2.65% or more, preferably 3.50% or less, more preferably 2.70% or more, and more preferably 3.40% or less.

P: 0.001% or more and 0.100% or less

P is an element that has a solid-solution strengthening effect and can increase the strength of the steel sheet. In order to obtain such an effect, it is necessary to set the P content to be 0.001% or more. On the other hand, when the P content exceeds 0.100%, P segregates in prior austenite grain boundaries to embrittle grain boundaries, resulting in a deterioration in toughness. Thus, a desired brittle-ductile transition temperature cannot be achieved. Furthermore, since P deteriorates ultimate deformability of the steel sheet, λ is decreased. Therefore, the P content is set to be 0.001% or more and 0.100% or less. The P content is preferably 0.002% or more, preferably 0.070% or less, more preferably 0.003% or more, and more preferably 0.050% or less.

S: 0.0200% or less

S is present as sulfides and deteriorates ultimate deformability of steel, thus decreasing λ. Bendability is also deteriorated. Therefore, it is necessary to set the S content to be 0.0200% or less. Although the lower limit of the S content is not specified, because of restrictions on production technology, the S content is preferably set to be 0.0001% or more. Therefore, the S content is set to be 0.0200% or less. The S content is preferably 0.0001% or more, and preferably 0.0050% or less.

Al: 0.010% or more and 1.000% or less

Al suppresses formation of carbides during continuous annealing and promotes formation of retained austenite, and thus is an element that affects the fraction of retained austenite and the carbon concentration in retained austenite. In order to obtain such effects, it is necessary to set the Al content to be 0.010% or more. On the other hand, when the Al content exceeds 1.000%, ferrite is formed, and YR cannot be controlled within a desired range. Therefore, the Al content is set to be 0.010% or more and 1.000% or less. The Al content is preferably 0.015% or more, preferably 0.500% or less, more preferably 0.020% or more, and more preferably 0.100% or less.

N: 0.0100% or less

N is present as nitrides and deteriorates ultimate deformability of the steel sheet, thus decreasing λ. Bendability is also deteriorated. Therefore, it is necessary to set the N content to be 0.0100% or less. Although the lower limit of the N content is not specified, because of restrictions on production technology, the N content is preferably set to be 0.0005% or more. Therefore, the N content is 0.0100% or less. The N content is preferably 0.0005% or more, and preferably 0.0050% or less.

The high-strength steel sheet of the disclosed embodiments preferably contains, in addition to the chemical composition described above, in percent by mass, at least one element selected from the group consisting of Ti: 0.001% or more and 0.100% or less, Nb: 0.001% or more and 0.100% or less, V: 0.001% or more and 0.100% or less, B: 0.0001% or more and 0.0100% or less, Mo: 0.010% or more and 0.500% or less, Cr: 0.01% or more and 1.00% or less, Cu: 0.01% or more and 1.00% or less, Ni: 0.01% or more and 0.50% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, and REM: 0.0001% or more and 0.0200% or less. These elements may be incorporated alone or in combination of two or more.

Ti, Nb, and V improve the strength of the steel sheet by forming fine carbides, nitrides, or carbonitrides during hot rolling or continuous annealing. Furthermore, by adding Ti, Nb, and V, the recrystallization temperature in the heating process during continuous annealing rises, and the average grain size of martensite and tempered martensite decreases. Thus, the toughness of the steel sheet can be improved. In order to obtain such effects, it is necessary to set the content of each of Ti, Nb, and V to be 0.001% or more. On the other hand, when the content of each of Ti, Nb, and V exceeds 0.100%, large amounts of coarse precipitates and inclusions are formed, which deteriorates ultimate deformability of the steel sheet, thus decreasing λ. Bendability is also deteriorated. Accordingly, when Ti, Nb, and V are added, the content of each is set to be 0.001% or more and 0.100% or less. The content of each is preferably 0.005% or more, and preferably 0.060% or less.

B is an element that can improve hardenability without decreasing the martensite transformation starting temperature, and can suppress formation of ferrite in the cooling process during continuous annealing. In order to obtain such effects, it is necessary to set the B content to be 0.0001% or more. On the other hand, when the B content exceeds 0.0100%, cracks occur inside the steel sheet during hot rolling, which deteriorates ultimate deformability of the steel sheet, thus decreasing λ. Bendability is also deteriorated. Accordingly, when B is added, its content is set to be 0.0001% or more and 0.0100% or less. The B content is preferably 0.0002% or more, and preferably 0.0050% or less.

Mo is an element that improves hardenability and that is effective in forming martensite and tempered martensite. In order to obtain such effects, it is necessary to set the Mo content to be 0.010% or more. On the other hand, when the Mo content exceeds 0.500%, the amounts of coarse precipitates and inclusions increase, which deteriorates ultimate deformability of the steel sheet, thus decreasing λ. Bendability is also deteriorated. Accordingly, when Mo is added, its content is set to be 0.010% or more and 0.500% or less. The Mo content is preferably 0.020% or more, and preferably 0.450% or less.

Cr and Cu not only function as solid-solution strengthening elements, but also stabilize austenite in the cooling process during continuous annealing, thus facilitating formation of martensite and tempered martensite. In order to obtain such effects, it is necessary to set the content of each of Cr and Cu to be 0.01% or more. On the other hand, when the content of each of Cr and Cu exceeds 1.00%, large amounts of coarse precipitates and inclusions are formed, which deteriorates ultimate deformability of the steel sheet, thus decreasing λ. Bendability is also deteriorated. Accordingly, when Cr and Cu are added, the content of each is set to be 0.01% or more and 1.00% or less. The content of each is preferably 0.02% or more, and preferably 0.70% or less.

Ni is an element that improves hardenability and that is effective in forming martensite and tempered martensite. In order to obtain such effects, it is necessary to set the Ni content to be 0.01% or more. On the other hand, when the Ni content exceeds 0.50%, the amounts of coarse precipitates and inclusions increase, which deteriorates ultimate deformability of the steel sheet, thus decreasing λ. Bendability is also deteriorated. Accordingly, when Ni is added, its content is set to be 0.01% or more and 0.50% or less. The Ni content is preferably 0.02% or more, and preferably 0.45% or less.

Sb and Sn are elements that are effective in controlling the thickness of a surface softened layer. In order to obtain such an effect, it is necessary to set the content of each of Sb and Sn to be 0.001% or more. On the other hand, when the content of each of Sb and Sn exceeds 0.200%, the amounts of coarse precipitates and inclusions increase, which deteriorates ultimate deformability of the steel sheet, thus decreasing λ. Bendability is also deteriorated. Accordingly, when Sb and Sn are added, the content of each is set to be 0.001% or more and 0.200% or less. The content of each is preferably 0.005% or more, and preferably 0.100% or less.

Ta improves the strength of the steel sheet by forming fine carbides, nitrides, or carbonitrides during hot rolling or continuous annealing, as in the case of Ti, Nb, and V. In addition, Ta is partially dissolved in Nb carbides or Nb carbonitrides to form complex precipitates, such as (Nb, Ta)(C, N), and markedly suppresses coarsening of precipitates, and thus, Ta is considered to have an effect of stabilizing the contribution to improvement in strength of the steel sheet through precipitation strengthening. In order to obtain such effects, it is necessary to set the Ta content to be 0.001%. On the other hand, when the Ta content exceeds 0.100%, large amounts of coarse precipitates and inclusions are formed, which deteriorates ultimate deformability of the steel sheet, thus decreasing λ. Bendability is also deteriorated. Accordingly, when Ta is added, its content is set to be 0.001% or more and 0.100% or less.

Ca and Mg are elements that are used for deoxidation and are effective in causing spheroidization of sulfides to improve ultimate deformability of the steel sheet. In order to obtain such effects, it is necessary to set the content of each of Ca and Mg to be 0.0001% or more. On the other hand, when the content of each of Ca and Mg exceeds 0.0200%, large amounts of coarse precipitates and inclusions are formed, which deteriorates ultimate deformability of the steel sheet, thus decreasing λ. Bendability is also deteriorated. Accordingly, when Ca and Mg are added, the content of each is set to be 0.0001% or more and 0.0200% or less.

All of Zn, Co, and Zr are elements that are effective in causing spheroidization of inclusions to improve ultimate deformability of the steel sheet. In order to obtain such an effect, it is necessary to set the content of each of Zn, Co, and Zr to be 0.001% or more. On the other hand, when the content of each of Zn, Co, and Zr exceeds 0.020%, large amounts of coarse precipitates and inclusions are formed, which deteriorates ultimate deformability of the steel sheet, thus decreasing λ. Bendability is also deteriorated. Accordingly, when Zn, Co, and Zr are added, the content of each is set to be 0.0001% or more and 0.0200% or less.

REM is an element that is effective in causing spheroidization of inclusions to improve ultimate deformability of the steel sheet. In order to obtain such an effect, it is necessary to set the REM content to be 0.0001% or more. On the other hand, when the REM content exceeds 0.0200%, large amounts of coarse precipitates and inclusions are formed, which deteriorates ultimate deformability of the steel sheet, thus decreasing λ. Bendability is also deteriorated. Accordingly, when REM is added, its content is set to be 0.0001% or more and 0.0200% or less.

The balance, other than the above-described elements, consists of Fe and unavoidable impurities. Note that, in the case where the optional elements are contained in amounts less than the lower limits, the advantageous effects of the disclosed embodiments are not impaired. Therefore, in the case where these optional elements are contained in amounts less than the lower limits, they are considered to be contained as unavoidable impurities.

The steel structure of the high-strength steel sheet of the disclosed embodiments will be described below.

Area fraction of martensite having a carbon concentration of more than 0.7×[% C] and less than 1.5×[% C]: 55% or more When the steel structure includes, as a main phase, martensite having a carbon concentration of more than 0.7×[% C] and less than 1.5×[% C], it is possible to achieve a TS of 1,180 MPa or more. In order to obtain such an effect, it is necessary to set the area fraction of martensite having a carbon concentration of more than 0.7×[% C] and less than 1.5×[% C] to be 55% or more. Although the upper limit of the area fraction of martensite having a carbon concentration of more than 0.7×[% C] and less than 1.5×[% C] is not specified, in order to achieve desired λ and YR, the upper limit is preferably 95% or less, and more preferably 90% or less. Therefore, the area fraction of martensite having a carbon concentration of more than 0.7×[% C] and less than 1.5×[% C] is set to be 55% or more. The area fraction is preferably 56% or more, preferably 95% or less, more preferably 57% or more, and more preferably 90% or less. Note that martensite having a carbon concentration of more than 0.7×[% C] and less than 1.5×[% C] can also be defined as quenched martensite. Furthermore, [% C] represents the content (percent by mass) of compositional element C in steel.

Area fraction of tempered martensite having a carbon concentration of 0.7×[% C] or less: 5% or more and 40% or less By forming tempered martensite having a carbon concentration of 0.7×[% C] or less adjacent to martensite having a carbon concentration of more than 0.7×[% C] and less than 1.5×[% C], desired λ and YR can be achieved. In order to obtain such an effect, it is necessary to set the area fraction of tempered martensite having a carbon concentration of 0.7×[% C] or less to be 5% or more. On the other hand, when the area fraction of tempered martensite having a carbon concentration of 0.7×[% C] or less exceeds 40%, the area fraction of martensite having a carbon concentration of more than 0.7×[% C] and less than 1.5×[% C] decreases, and it becomes difficult to achieve a TS of 1,180 MPa or more. Therefore, the area fraction of tempered martensite having a carbon concentration of 0.7×[% C] or less is set to be 5% or more and 40% or less. The area fraction is preferably 6% or more, preferably 39% or more, more preferably 7% or more, and more preferably 38% or more. Note that tempered martensite having a carbon concentration of 0.7×[% C] or less can be defined as bainite. Furthermore, [% C] represents the content (percent by mass) of compositional element C in steel.

The method for measuring the area fraction of martensite having a carbon concentration of more than 0.7×[% C] and less than 1.5×[% C] and the area fraction of tempered martensite having a carbon concentration of 0.7×[% C] or less is as follows.

After a specimen is cut out such that a cross section in the thickness direction parallel to the rolling direction of the steel sheet (L cross section) serves as an observation surface, the observation surface is polished with diamond paste, and then final polishing is performed using alumina. Using an Electron Probe Micro Analyzer (EPMA), 3 fields of view were measured under conditions of an accelerating voltage of 7 kV and a measurement region of 22.5 μm×22.5 μm. The measured data were converted into carbon concentrations by a calibration curve method. The data in the 3 fields of view were added together. By defining a region in which the carbon concentration is more than 0.7×[% C] and less than 1.5×[% C] as martensite and a region in which the carbon concentration is 0.7×[% C] or less as tempered martensite, the area fraction of each was calculated.

Ratio of the carbon concentration in retained austenite to the volume fraction of retained austenite: 0.05 or more and 0.40 or less In the disclosed embodiments, the ratio of the carbon concentration in retained austenite to the volume fraction of retained austenite (carbon concentration in retained austenite [% by mass]/volume fraction of retained austenite [% by volume]) is a very important feature of the embodiments. By simultaneously controlling the volume fraction of retained austenite and the carbon concentration in retained austenite, desired YR can be achieved. In order to obtain such an effect, it is necessary to set the ratio of the carbon concentration in retained austenite to the volume fraction of retained austenite to be 0.05 or more. On the other hand, when the ratio of the carbon concentration in retained austenite to the volume fraction of retained austenite exceeds 0.40, the hardness of martensite transformed from retained austenite during blanking increases greatly, resulting in an increase in void formation during blanking and hole expansion, thus decreasing λ. Furthermore, YR is increased. Therefore, the ratio of the carbon concentration in retained austenite to the volume fraction of retained austenite is set to be 0.05 or more and 0.40 or less. The ratio is preferably 0.07 or more, preferably 0.38 or less, more preferably 0.09 or more, and more preferably 0.36 or less.

The method for measuring the ratio of the carbon concentration in retained austenite to the volume fraction of retained austenite is as follows.

Grinding was performed so that an observation surface was located at the position of ¼ of the thickness from the surface layer of the steel sheet (the position corresponding to ¼ of the thickness in the depth direction from the surface of the steel sheet), and then polishing was further performed by 0.1 mm by chemical polishing. On the polished surface, with an X-ray diffractometer, using a Co-Kα ray source, the integrated reflection intensity of the (200) plane, (220) plane, and (311) plane of austenite and the (200) plane, (211) plane, and (220) plane of ferrite was measured. The volume fraction of austenite was obtained from the intensity ratio of the integrated reflection intensity of each plane of austenite to the integrated reflection intensity of each plane of ferrite, and this was determined as the volume fraction of retained austenite. Furthermore, regarding the carbon concentration in retained austenite, first, the lattice constant of retained austenite was calculated from the shift amount of diffraction peak of the (220) plane of austenite by the formula (2) below, and calculation was performed by substituting the obtained lattice constant of retained austenite into the formula (3) below.

$$a=1.79021\sqrt{2}/\text{sine}\ \theta \tag{2}$$

$$a=3.578+0.00095[\text{Mn}]+0.022[\text{N}]+0.0006[\text{Cr}]+0.0031[\text{Mo}]+0.0051[\text{Nb}]+0.0039[\text{Ti}]++0.0056[\text{Al}]+0.033[\text{C}] \tag{3}$$

where a is the lattice constant (Å) of retained austenite, θ is the value (rad) obtained by dividing the diffraction peak angle of the (220) plane by 2, [M] is the percent by mass of an element M in retained austenite. In the disclosed embodiments, the percent by mass of the element M other than C in retained austenite is the percent by mass relative to the entire steel.

Average grain size of martensite and tempered martensite: 5.3 μm or less

In the disclosed embodiments, the average grain size of martensite and tempered martensite is a very important feature of the embodiments. In order to obtain the desired material properties, it is important to refine the structure of martensite and tempered martensite. Since both martensite and tempered martensite are generated from austenite, both the grain size of martensite and the grain size of tempered martensite are influenced by the grain size of austenite. Therefore, it is not necessary to distinguish between martensite and tempered martensite and to control their respective grain sizes. By reducing the average grain size of martensite and tempered martensite, the toughness of the steel sheet can be improved. In order to obtain such an effect, it is necessary to set the average grain size of each of martensite and tempered martensite to be 5.3 μm or less. Although the lower limit of the average grain size of each of martensite and tempered martensite is not particularly limited, in order to achieve desired YR, the average grain size is preferably 1.0 μm or more, and more preferably 2.0 μm or more. Therefore, the average grain size of each of martensite and tempered martensite is set to be 5.3 μm or less. The average grain size is preferably 1.0 μm or more, preferably 5.0 μm or less, more preferably 2.0 μm or more, and more preferably 4.9 μm or less.

The method for measuring the average grain size of martensite and tempered martensite is as follows.

The surface of a cross section in the thickness direction parallel to the rolling direction of the steel sheet (L cross section) was smoothed by wet polishing and buffing using a colloidal silica solution. Then, etching was performed with 0.1 vol. % Nital to minimize the irregularities on the surface of the specimen and to completely remove a work affected layer. Next, the crystal orientations were measured at a ¼ thickness position by an SEM-EBSD (Electron Back-Scatter Diffraction) method under the condition of a step size of 0.05 μm. By analyzing the obtained data using OIM Analysis available from EDAX, a division of AMETEK, Inc., the case in which the misorientation between pixels was 5° or more was defined as a grain boundary, and calculation was performed. In this data, the original data was subjected to a clean-up process once using a Grain Dilation method (Grain Tolerance Angle: 5, Minimum Grain Size: 2), and then a CI (Confidence Index)>0.05 was set as a threshold value.

Thickness of surface softened layer: 10 μm or more and 100 μm or less (optimal condition)

By softening a surface layer portion of the steel sheet compared with the ¼ thickness position, desired bendability can be achieved. In order to obtain such an effect, it is preferable to set the thickness of a surface softened layer to be 10 μm or more. On the other hand, in order to achieve desired TS, it is preferable to set the thickness of the surface softened layer to be 100 μm or less. Accordingly, the thickness of the surface softened layer is preferably set to be 10 μm or more and 100 μm or less. The thickness is more preferably 12 μm or more, more preferably 80 μm or less, still more preferably 15 μm or more, and still more preferably 60 μm or less.

The method for measuring the thickness of the surface softened layer is as follows.

The surface of a cross section in the thickness direction parallel to the rolling direction of the steel sheet (L cross section) was smoothed by wet polishing. Then, using a Vickers hardness tester, with a load of 25 gf, measurement was performed from the position of 5 μm from the surface layer to the center of the thickness, at an interval of 5 μm. The region in which the hardness is reduced by 85% from the hardness obtained at a ¼ thickness position was defined as a softened region, and the thickness of a layer extending from the surface layer of the steel sheet to the softened region was defined as the thickness of a surface softened layer.

Furthermore, in the steel structure according to the disclosed embodiments, in addition to the martensite (quenched martensite), tempered martensite (bainite), and retained austenite described above, even when ferrite, pearlite, carbides such as cementite, and any other known structure of a steel sheet are contained, as long as the area fraction thereof is 3% or less, the advantageous effects of the disclosed embodiments are not impaired. Note that the other structure of the steel sheet (remainder structure) may be confirmed and determined, for example, by SEM observation.

The chemical composition and the steel structure of the high-strength steel sheet of the disclosed embodiments are as described above. Furthermore, although not particularly limited, the thickness of the high-strength steel sheet is usually 0.3 mm or more and 2.8 mm or less.

Moreover, the high-strength steel sheet of the disclosed embodiments may further have a coating layer on a surface of the steel sheet. The kind of the coating layer is not particularly limited, and for example, may be either a hot-dip coating layer or an electroplating layer. Furthermore, the coating layer may be an alloyed coating layer. The coating layer is preferably a galvanizing layer. The galvanizing layer may contain Al and Mg. A hot-dip zinc-aluminum-magnesium alloy coating (Zn—Al—Mg coating layer) is also preferable. In this case, preferably, the Al content is 1% by mass or more and 22% by mass or less, the Mg content is 0.1% by mass or more and 10% by mass or less, and the balance is Zn. Furthermore, in the case of a Zn—Al—Mg coating layer, in addition to Zn, Al, and Mg, the coating layer may contain at least one selected from Si, Ni, Ce, and La in a total amount of 1% by mass or less. Since the coating metal is not particularly limited, besides the Zn coating described above, Al coating or the like may be used.

Furthermore, the composition of the coating layer is not particularly limited, and may be a generally used composition. For example, in the case of a hot-dip galvanizing layer or hot-dip galvannealing layer, the composition generally contains Fe: 20% by mass or less, Al: 0.001% by mass or more and 1.0% by mass or less, and one or two or more selected from the group consisting of Pb, Sb, Si, Sn, Mg, Mn, Ni, Cr, Co, Ca, Cu, Li, Ti, Be, Bi, and REM in a total amount of 0% by mass or more and 3.5% by mass or less, with the balance being Zn and unavoidable impurities. In the disclosed embodiments, preferably, a hot-dip galvanizing layer or hot-dip galvannealing layer obtained by further alloying the hot-dip galvanizing layer with a coating weight of 20 to 80 g/m$^2$ per one side is provided. Furthermore, when the coating layer is a hot-dip galvanizing layer, the Fe content in the coating layer is less than 7% by mass, and when the coating layer is a hot-dip galvannealing layer, the Fe content in the coating layer is 7 to 20% by mass.

Next, a manufacturing method of the disclosed embodiments will be described.

In the disclosed embodiments, the melting method of steel (steel slab) is not particularly limited, and any known melting method using a converter, electric furnace, or the like can be suitably used. Furthermore, a steel slab (slab) is preferably produced by a continuous casting process so as to prevent macrosegregation, but it can also be produced by an ingot-making process, thin slab casting process, or the like. Furthermore, in addition to the existing process in which the produced steel slab is cooled to room temperature and then reheated, an energy-saving process, such as direct charge rolling/direct rolling, can be used without a problem, in which a hot slab is charged into a heating furnace without being cooled to room temperature or is directly rolled after short heat retention. When the slab is heated, from the viewpoint of melting of carbides and reduction in rolling load, the slab heating temperature is preferably set to be 1,100° C. or higher. Furthermore, in order to prevent an increase in scale loss, the slab heating temperature is preferably set to be 1,300° C. or lower. Note that the slab heating temperature is the temperature at the surface of the slab. Furthermore, the slab is formed into a sheet bar by rough rolling under the usual conditions. In the case where the heating temperature is set on a lower side, from the viewpoint of preventing trouble during hot rolling, it is preferable to heat the sheet bar using a bar heater or the like before finish rolling. In finish rolling, in some cases, the rolling load increases, the rolling reduction in the unrecrystallized austenite state increases, and an abnormal structure extending in the rolling direction develops, which may result in degradation in workability of the annealed sheet. Therefore, it is preferable to perform finish rolling at a finish rolling temperature equal to or higher than the $Ar_3$ transformation point. Furthermore, the coiling temperature after hot rolling is preferably set to be 300° C. or higher and 700° C. or lower in view of the concern that the workability of the annealed sheet might be degraded.

During hot-rolling, rough-rolled sheets may be joined with each other and finish rolling may be conducted continuously. Moreover, the rough-rolled sheet may be temporarily coiled. Furthermore, in order to reduce the rolling load during hot rolling, parts or the whole of the finish rolling may be performed as lubrication rolling. Performing lubrication rolling is also effective from the viewpoint of making the shape and material properties of the steel sheet uniform. The coefficient of friction during lubrication rolling is preferably in the range of 0.10 or more and 0.25 or less.

The hot-rolled steel sheet thus produced is subjected to pickling. Pickling enables removal of oxides from the surface of the steel sheet, and is therefore important to ensure good chemical conversion treatability and coating quality in the high-strength steel sheet as the final product. Furthermore, the pickling may be performed once or a plurality of times.

When the pickled hot-rolled sheet thus obtained is subjected to cold rolling, the pickled hot-rolled sheet may be subjected to cold rolling as it is or may be subjected to heat treatment and then cold rolling.

Although the conditions for cold rolling are not particularly limited, the rolling reduction in the cold rolling is preferably set to be 30% or more and 80% or less. Without particular limitations to the number of rolling passes and the rolling reduction in each pass, the advantageous effects of the disclosed embodiments can be obtained.

The cold-rolled steel sheet thus obtained is subjected to annealing. The annealing conditions are as follows.

Average heating rate in a temperature range of 250° C. or higher and 700° C. or lower: 10° C./s or more In the disclosed embodiments, the average heating rate in a temperature range of 250° C. or higher and 700° C. or lower is a very important feature of the embodiments. By increasing the average heating rate in a temperature range of 250° C. or higher and 700° C. or lower, the average grain size of martensite and tempered martensite can be controlled, and desired toughness can be achieved. In order to obtain such an effect, it is necessary to set the average heating rate in a temperature range of 250° C. or higher and 700° C. or lower to be 10° C./s or more. Although the upper limit of the average heating rate in the temperature range of 250° C. or higher and 700° C. or lower is not particularly specified, in order to achieve desired YR, the upper limit is preferably 50° C./s or less, and more preferably 40° C./s or less. Therefore, the average heating rate in a temperature range of 250° C. or higher and 700° C. or lower is set to be 10° C./s or more. The average heating rate is preferably 12° C./s or more, preferably 50° C./s or less, more preferably 14° C./s or more, and more preferably 40° C./s or less.

Heating temperature: 850° C. or higher and 950° C. or lower

When the heating temperature (annealing temperature) is lower than 850° C., since annealing treatment is performed in the ferrite-austenite two-phase region, a large amount of ferrite is present after annealing. Therefore, it becomes difficult to achieve desired λ and YR. On the other hand, when the heating temperature exceeds 950° C., crystal grains of austenite during annealing are coarsened, and the average grain size of martensite and tempered martensite is increased. Thus, desired toughness cannot be achieved. Therefore, the heating temperature is set to be 850° C. or higher and 950° C. or lower. The heating temperature is preferably 860° C. or higher, preferably 940° C. or lower, more preferably 870° C. or higher, and more preferably 930° C. or lower.

Furthermore, the holding time at the heating temperature is not particularly limited, but is preferably set to be 10 s or more and 600 s or less.

Furthermore, the average cooling rate in a temperature range equal to or lower than the heating temperature and 400° C. or higher is not particularly limited, but is preferably set to be 5° C./s or more and 30° C./s or less.

Oxygen concentration in the heating temperature range: 2 ppm or more and 30 ppm or less (optimal condition)

During annealing, by increasing the oxygen concentration in the heating temperature range, decarbonization occurs via oxygen in the air, and a softened layer can be formed in the surface layer portion of the steel sheet. As a result, desired R/t can be achieved. In order to obtain such an effect, it is preferable to set the oxygen concentration in the heating temperature range to be 2 ppm or more. On the other hand, in order to achieve desired TS, it is preferable to set the oxygen concentration in the heating temperature range to be 30 ppm or less. Accordingly, the oxygen concentration in the heating temperature range is preferably set to be 2 ppm or more and 30 ppm or less. The oxygen concentration is more preferably 4 ppm or more, more preferably 28 ppm or less, still more preferably 5 ppm or more, and still more preferably 25 ppm or less. Note that the temperature in the heating temperature range is based on the surface temperature of the steel sheet. That is, when the surface temperature of the steel sheet is in the heating temperature range, the oxygen concentration is adjusted to the range described above.

Dew point in the heating temperature range: −35° C. or higher (optimal condition)

During annealing, by increasing the dew point in the heating temperature range, decarbonization occurs via moisture in the air, and a softened layer can be formed in the surface layer portion of the steel sheet. As a result, desired R/t can be achieved. In order to obtain such an effect, it is preferable to set the dew point in the heating temperature range to be −35° C. or higher. Although the upper limit of the dew point in the heating temperature range is not particularly specified, in order to achieve desired TS, the upper limit is preferably 15° C. or lower, and more preferably 5° C. or lower. Accordingly, the dew point in the heating temperature range is preferably set to be −35° C. or higher. The dew point is more preferably −30° C. or higher, more preferably 15° C. or lower, still more preferably −25° C. or higher, and still more preferably 5° C. or lower. Note that the temperature in the heating temperature range is based on the surface temperature of the steel sheet. That is, when the surface temperature of the steel sheet is in the heating temperature range, the dew point is adjusted to the range described above.

Holding time in a temperature range of 50° C. or higher and 400° C. or lower: 70 s or more and 700 s or less In the disclosed embodiments, the holding time in a temperature range of 50° C. or higher and 400° C. or lower is a very important feature of the embodiments. By appropriately controlling the holding time in a temperature range of 50° C. or higher and 400° C. or lower, the volume fraction of retained austenite and the carbon concentration in retained austenite can be controlled. As a result, desired YR can be achieved. In order to obtain such an effect, it is necessary to set the holding time in a temperature range of 50° C. or higher and 400° C. or lower to be 70 s or more. On the other hand, when the holding time in a temperature range of 50° C. or higher and 400° C. or lower exceeds 700 s, the carbon concentration in retained austenite increases, and the hardness of martensite transformed from retained austenite during blanking increases greatly, resulting in an increase in void formation during blanking and hole expansion, thus decreasing λ. Furthermore, YR is increased. Therefore, the holding time in a temperature range of 50° C. or higher and 400° C. or lower is set to be 70 s or more and 700 s or less. The holding time is preferably 75 s or more, preferably 500 s or less, more preferably 80 s or more, and more preferably 400 s or less.

Average cooling rate in a temperature range of 50° C. or higher and 250° C. or lower: 10.0° C./s or less In the disclosed embodiments, the average cooling rate in a temperature range of 50° C. or higher and 250° C. or lower is a very important feature of the embodiments. By appropriately controlling the average cooling rate in a temperature range of 50° C. or higher and 250° C. or lower, the volume fraction of retained austenite and the carbon concentration in retained austenite can be controlled. As a result, desired YR can be achieved. In order to obtain such an effect, it is necessary to set the average cooling rate in a temperature range of 50° C. or higher and 250° C. or lower to be 10.0° C./s or less. Although the lower limit of the average cooling rate in a temperature range of 50° C. or higher and 250° C. or lower is not particularly specified, in order to achieve desired λ, the lower limit is preferably 0.5° C./s or more, and more preferably 1.0° C./s or more. Therefore, the average cooling rate in a temperature range of 50° C. or higher and 250° C. or lower is set to be 10.0° C./s or less. The average cooling rate is preferably 0.5° C./s or more, preferably 7.0° C./s, more preferably 1.0° C./s or more, and more preferably 5.0° C./s.

It is not necessary to particularly specify cooling at lower than 50° C., and cooling may be performed to a desired temperature by any method. The desired temperature is preferably about room temperature.

Furthermore, the high-strength steel sheet may be subjected to temper rolling. When the rolling reduction in skin pass rolling exceeds 1.5%, the yield stress of steel increases and YR increases. Therefore, the rolling reduction is preferably 1.5% or less. Although the lower limit of the rolling reduction in skin pass rolling is not particularly limited, from the viewpoint of productivity, the lower limit is preferably 0.1% or more.

Furthermore, when a high-strength steel sheet is traded, it is usually traded after being cooled to room temperature.

In the disclosed embodiments, after annealing, the high-strength steel sheet may be further subjected to coating treatment. As the coating treatment, for example, hot-dip galvanizing treatment or treatment in which alloying is performed after hot-dip galvanizing may be used. Furthermore, annealing and galvanizing may be continuously performed in one line. In addition, the coating layer may be formed by electroplating such as Zn—Ni alloy electroplating, or hot-dip zinc-aluminum-magnesium alloy plating may be performed. Although the above description has focused on galvanizing, the kind of the coating metal, such as Zn coating or Al coating, is not particularly limited.

When hot-dip galvanizing treatment is performed, a high-strength steel sheet is immersed in a galvanizing bath at 440° C. or higher and 500° C. or lower and subjected to hot-dip galvanizing treatment, and then, the coating weight is adjusted by gas wiping or the like. In hot-dip galvanizing, it is preferable to use a galvanizing bath having an Al content of 0.10% by mass or more and 0.23% by mass or less. Furthermore, when alloying treatment of galvanizing is performed, after hot-dip galvanizing, the alloying treatment of galvanizing is performed in a temperature range of 470° C. or higher and 600° C. or lower. At lower than 470° C., the Zn?Fe alloying rate becomes excessively slow, and productivity is impaired. On the other hand, when the alloying treatment is performed at a temperature higher than 600° C., untransformed austenite may transform into pearlite, resulting in deterioration in TS in some cases. Accordingly, when alloying treatment of galvanizing is performed, the alloying treatment is preferably performed in a temperature range of 470° C. or higher and 600° C. or lower, and more preferably performed in a temperature range of 470° C. or higher and 560° C. or lower. Furthermore, electro-galvanizing treatment may be performed. Furthermore, the coating weight is preferably 20 to 80 g/m$^2$ per one side (double-sided coating), and by subjecting a hot-dip galvannealed steel sheet (GA) to the alloying treatment described below, the Fe concentration in the coating layer is preferably set to be 7 to 15% by mass.

In skin pass rolling after the coating treatment, the rolling reduction is preferably in the range of 0.1% or more and 2.0% or less. At less than 0.1%, the effect is small, and control is difficult. Therefore, this is the lower limit of the satisfactory range. At more than 2.0%, productivity is markedly reduced, and YR is increased. Therefore, this is the upper limit of the satisfactory range. The skin pass rolling may be performed on-line or off-line. Furthermore, skin pass rolling may be performed once to achieve a target rolling reduction or may be divided into several times.

Although other conditions of the manufacturing method are not particularly limited, from the viewpoint of productivity, a series of processes, such as the annealing, hot-dip galvanizing, and alloying treatment of galvanizing, are preferably performed in a CGL (Continuous Galvanizing Line) which is a hot-dip galvanizing line. After hot-dip galvanizing, wiping can be performed to adjust the coating weight. Conditions of coating and the like other than those described above may be in accordance with the usual method of hot-dip galvanizing.

Examples

Steels having the chemical compositions shown in Table 1, with the balance being Fe and unavoidable impurities, were each melted in a converter, and slabs were formed by a continuous casting process. The resulting slabs were heated, subjected to hot rolling, followed by pickling treatment, and then subjected to cold rolling.

Next, by performing annealing under the conditions shown in Table 2, high-strength cold rolled steel sheets (CR) were obtained. Some of the high-strength cold rolled steel sheets were further subjected to coating treatment to obtain hot-dip galvanized steel sheets (GI), hot-dip galvannealed steel sheets (GA), and an electro-galvanized steel sheet (EG). As the hot-dip galvanizing bath, in GI, a zinc bath containing Al: 0.14 to 0.19% by mass was used, and in GA, a zinc bath containing Al: 0.14% by mass was used. The bath temperature was set to be 470° C. The coating weight was about 45 to 72 g/m$^2$ per one side (double-sided coating) in GI, and about 45 g/m$^2$ per one side (double-sided coating) in GA. Furthermore, in GA, the Fe concentration in the coating layer was set to be 9% by mass or more and 12% by mass or less. In EG in which the coating layer was a Zn—Ni coating layer, the Ni content in the coating layer was set to be 9% by mass or more and 25% by mass or less.

TABLE 1

| Steel | Chemical composition (mass %) | | | | | | | | | | | | | |
|---|---|---|---|---|---|---|---|---|---|---|---|---|---|---|
| grade | C | Si | Mn | P | S | Al | N | Ti | Nb | V | B | Mo | Cr | Cu |
| A | 0.211 | 1.03 | 3.07 | 0.029 | 0.0015 | 0.046 | 0.0006 | — | — | — | — | — | — | — |
| B | 0.257 | 1.10 | 3.20 | 0.014 | 0.0002 | 0.022 | 0.0031 | — | — | — | — | — | — | — |
| C | 0.109 | 1.08 | 2.99 | 0.038 | 0.0049 | 0.041 | 0.0034 | — | — | — | — | — | — | — |

TABLE 1-continued

| | | | | | | | | | | | | | | |
|---|---|---|---|---|---|---|---|---|---|---|---|---|---|---|
| D | 0.369 | 1.16 | 3.11 | 0.024 | 0.0034 | 0.038 | 0.0019 | — | — | — | — | — | — | — |
| E | 0.256 | 1.02 | 3.16 | 0.003 | 0.0036 | 0.023 | 0.0036 | — | — | — | — | — | — | — |
| F | 0.071 | 1.01 | 3.19 | 0.024 | 0.0042 | 0.033 | 0.0043 | — | — | — | — | — | — | — |
| G | 0.105 | 2.11 | 2.95 | 0.006 | 0.0010 | 0.032 | 0.0033 | — | — | — | — | — | — | — |
| H | 0.114 | 1.00 | 1.95 | 0.028 | 0.0035 | 0.030 | 0.0012 | — | — | — | — | — | — | — |
| I | 0.106 | 1.06 | 3.81 | 0.040 | 0.0002 | 0.042 | 0.0012 | — | — | — | — | — | — | — |
| J | 0.194 | 1.04 | 3.16 | 0.010 | 0.0030 | 0.022 | 0.0012 | 0.045 | — | — | — | — | — | — |
| K | 0.154 | 1.13 | 3.05 | 0.026 | 0.0001 | 0.049 | 0.0049 | — | 0.015 | — | — | — | — | — |
| L | 0.180 | 0.88 | 3.19 | 0.010 | 0.0013 | 0.046 | 0.0027 | — | — | 0.021 | — | — | — | — |
| M | 0.166 | 0.91 | 2.66 | 0.005 | 0.0041 | 0.027 | 0.0008 | 0.022 | — | — | 0.0013 | — | — | — |
| N | 0.279 | 1.00 | 2.93 | 0.029 | 0.0042 | 0.045 | 0.0040 | — | — | — | — | 0.065 | — | — |
| O | 0.191 | 1.10 | 2.92 | 0.047 | 0.0043 | 0.020 | 0.0041 | — | — | — | — | — | 0.23 | — |
| P | 0.285 | 0.93 | 3.10 | 0.008 | 0.0044 | 0.035 | 0.0031 | — | — | — | — | — | — | 0.18 |
| Q | 0.169 | 1.15 | 3.33 | 0.004 | 0.0017 | 0.047 | 0.0012 | — | — | — | — | — | — | — |
| R | 0.292 | 1.13 | 3.07 | 0.007 | 0.0008 | 0.026 | 0.0017 | — | — | — | — | — | — | — |
| S | 0.214 | 1.01 | 3.04 | 0.048 | 0.0005 | 0.038 | 0.0016 | — | — | — | — | — | — | — |
| T | 0.168 | 1.16 | 3.11 | 0.018 | 0.0036 | 0.036 | 0.0035 | — | — | — | — | — | — | — |
| U | 0.155 | 1.16 | 3.00 | 0.047 | 0.0037 | 0.031 | 0.0030 | — | 0.022 | — | — | — | — | — |
| V | 0.340 | 1.04 | 3.12 | 0.006 | 0.0003 | 0.033 | 0.0010 | — | — | — | — | — | — | — |
| W | 0.201 | 1.00 | 3.03 | 0.038 | 0.0045 | 0.033 | 0.0017 | — | — | — | — | — | — | — |
| X | 0.178 | 1.04 | 3.01 | 0.008 | 0.0031 | 0.042 | 0.0018 | — | — | — | — | — | — | — |
| Y | 0.119 | 1.19 | 3.14 | 0.039 | 0.0010 | 0.028 | 0.0031 | — | — | — | — | — | — | — |
| Z | 0.168 | 0.99 | 3.17 | 0.009 | 0.0004 | 0.026 | 0.0006 | 0.024 | 0.019 | — | 0.0016 | — | — | 0.11 |

| Steel | Chemical composition (mass %) | | | | | | | | | | |
|---|---|---|---|---|---|---|---|---|---|---|---|
| grade | Ni | Sb | Sn | Ta | Ca | Mg | Zn | Co | Zr | REM | Remarks |
| A | — | — | — | — | — | — | — | — | — | — | Example steel |
| B | — | — | — | — | — | — | — | — | — | — | Example steel |
| C | — | — | — | — | — | — | — | — | — | — | Example steel |
| D | — | — | — | — | — | — | — | — | — | — | Example steel |
| E | — | — | — | — | — | — | — | — | — | — | Example steel |
| F | — | — | — | — | — | — | — | — | — | — | Comparative steel |
| G | — | — | — | — | — | — | — | — | — | — | Comparative steel |
| H | — | — | — | — | — | — | — | — | — | — | Comparative steel |
| I | — | — | — | — | — | — | — | — | — | — | Comparative steel |
| J | — | — | — | — | — | — | — | — | — | — | Example steel |
| K | — | — | — | — | — | — | — | — | — | — | Example steel |
| L | — | — | — | — | — | — | — | — | — | — | Example steel |
| M | — | — | — | — | — | — | — | — | — | — | Example steel |
| N | — | — | — | — | — | — | — | — | — | — | Example steel |
| O | — | — | — | — | — | — | — | — | — | — | Example steel |
| P | — | — | — | — | — | — | — | — | — | — | Example steel |
| Q | 0.13 | — | — | — | — | — | — | — | — | — | Example steel |
| R | — | 0.011 | — | — | — | — | — | — | — | — | Example steel |
| S | — | — | 0.008 | — | — | — | — | — | — | — | Example steel |
| T | — | — | — | 0.009 | — | — | — | — | — | — | Example steel |
| U | — | — | — | 0.014 | — | — | — | — | — | — | Example steel |
| V | — | — | — | — | 0.0003 | — | — | — | — | — | Example steel |
| W | — | — | — | — | — | 0.0013 | — | — | — | — | Example steel |
| X | — | — | — | — | — | — | 0.005 | 0.002 | 0.003 | — | Example steel |
| Y | — | — | — | — | — | — | — | — | — | 0.0027 | Example steel |
| Z | — | 0.015 | — | — | — | — | — | — | — | — | Example steel |

Underlined values: outside the scope of the disclosed embodiments.

TABLE 2

| | | Annealing conditions | | | |
|---|---|---|---|---|---|
| No. | Steel grade | Average heating rate at 250 to 700° C. (° C./s) | Heating temperature (° C.) | Oxygen concentration in heating temperature range (ppm) | Dew point in heating temperature range (° C.) |
| 1 | A | 20 | 880 | 13 | −17 |
| 2 | B | 40 | 910 | 17 | −11 |
| 3 | C | 20 | 890 | 15 | −13 |
| 4 | C | 7 | 890 | 11 | −13 |
| 5 | C | 20 | 820 | 11 | −13 |
| 6 | C | 20 | 980 | 11 | −13 |
| 7 | C | 20 | 890 | 11 | −13 |
| 8 | C | 20 | 890 | 11 | −13 |
| 9 | C | 20 | 890 | 11 | −13 |
| 10 | D | 18 | 890 | 13 | −9 |
| 11 | E | 10 | 910 | 14 | −14 |

TABLE 2-continued

| | | | | | |
|---|---|---|---|---|---|
| 12 | F | 18 | 900 | 17 | −13 |
| 13 | G | 18 | 900 | 17 | −13 |
| 14 | H | 18 | 900 | 17 | −13 |
| 15 | I | 18 | 900 | 17 | −13 |
| 16 | J | 12 | 890 | 12 | −5 |
| 17 | K | 17 | 910 | 11 | −25 |
| 18 | L | 48 | 900 | 14 | −13 |
| 19 | M | 16 | 890 | 20 | −24 |
| 20 | N | 23 | 850 | 12 | −17 |
| 21 | O | 16 | 940 | 21 | −13 |
| 22 | P | 24 | 890 | 30 | −17 |
| 23 | Q | 15 | 900 | 16 | −34 |
| 24 | R | 14 | 920 | 13 | −19 |
| 25 | S | 14 | 870 | 4 | −21 |
| 26 | T | 25 | 910 | 12 | −27 |
| 27 | U | 14 | 930 | 20 | −4 |
| 28 | V | 26 | 890 | 22 | 5 |
| 29 | W | 31 | 920 | 18 | −2 |
| 30 | X | 27 | 890 | 27 | −19 |
| 31 | Y | 34 | 900 | 14 | −25 |
| 32 | Z | 27 | 870 | 12 | −16 |
| 33 | Z | 27 | 870 | 1 | −16 |
| 34 | C | 27 | 870 | 34 | −16 |
| 35 | Z | 27 | 870 | 12 | −36 |

| | Annealing conditions | | | |
|---|---|---|---|---|
| No. | Holding time in a temperature range of 50 to 400° C. during cooling (s) | Average cooling rate in a temperature range of 50 to 250° C. during cooling (° C./s) | Type* | Remarks |
| 1 | 110 | 2.5 | CR | Example |
| 2 | 115 | 2.0 | GA | Example |
| 3 | 110 | 2.5 | GA | Example |
| 4 | 110 | 2.5 | GA | Comparative Example |
| 5 | 110 | 2.5 | GA | Comparative Example |
| 6 | 110 | 2.5 | GA | Comparative Example |
| 7 | 55 | 5.0 | GA | Comparative Example |
| 8 | 1000 | 1.0 | GA | Comparative Example |
| 9 | 110 | 15.0 | GA | Comparative Example |
| 10 | 120 | 2.0 | CR | Example |
| 11 | 215 | 1.0 | GA | Example |
| 12 | 125 | 2.0 | GI | Comparative Example |
| 13 | 125 | 2.0 | GA | Comparative Example |
| 14 | 125 | 2.0 | GA | Comparative Example |
| 15 | 125 | 2.0 | GA | Comparative Example |
| 16 | 190 | 1.5 | GA | Example |
| 17 | 130 | 1.5 | CR | Example |
| 18 | 80 | 3.0 | GA | Example |
| 19 | 135 | 1.5 | EG | Example |
| 20 | 95 | 2.5 | GA | Example |
| 21 | 140 | 1.5 | GA | Example |
| 22 | 90 | 2.5 | GA | Example |
| 23 | 150 | 1.5 | GA | Example |
| 24 | 650 | 0.4 | GA | Example |

TABLE 2-continued

| | | | | |
|---|---|---|---|---|
| 25 | 155 | 1.5 | GA | Example |
| 26 | 85 | 3.0 | GA | Example |
| 27 | 320 | 1.0 | CR | Example |
| 28 | 85 | 4.0 | CR | Example |
| 29 | 75 | 7.0 | GA | Example |
| 30 | 85 | 3.0 | GA | Example |
| 31 | 180 | 1.5 | GI | Example |
| 32 | 460 | 0.5 | GA | Example |
| 33 | 460 | 0.5 | GA | Example |
| 34 | 460 | 0.5 | GA | Example |
| 35 | 460 | 0.5 | GA | Example |

Underlined values: outside the scope of the disclosed embodiments.

*CR: cold rolled steel sheet (without plating), GI: hot-dip galvanized steel sheet (without alloying treatment of galvanizing), GA: hot-dip galvannealed steel sheet, EG: electro-galvanized steel sheet (Zn—Ni alloy coating)

The high-strength cold rolled steel sheets and coated steel sheets thus obtained were used as test steels, and tensile properties, stretch-flange formability, bendability, and toughness were evaluated in accordance with the following test methods.

Tensile Test

A tensile test was performed in accordance with JIS Z 2241. A JIS No. 5 test specimen was taken from each of the obtained steel sheets so as to be perpendicular to the rolling direction of the steel sheet. The tensile test was performed under the condition of a cross head speed of $1.67\times10^{-1}$ mm/s, and YS and TS were determined. In the disclosed embodiments, a TS of 1,180 MPa or more was evaluated as pass. Furthermore, regarding excellence in component dimensional accuracy, a yield ratio (YR), which is an indicator of component dimensional accuracy, of 65% or more and 85% or less was evaluated as good. Note that YR was calculated by the calculation method according to the formula (1) described above.

Hole-Expanding Test

A hole-expanding test was performed in accordance with JIS Z 2256. The obtained steel sheet was cut into a specimen with a size of 100 mm×100 mm, and a hole with a diameter of 10 mm was punched in the specimen with a clearance of 12.5%. Then, using a die with an inside diameter of 75 mm, a conical punch with the vertex angle 60° was forced into the hole with a holding force of 9 ton (88.26 kN) being applied, and a hole diameter at the crack generation limit was measured. A limiting hole expansion ratio: λ (%) was obtained from the following formula, and the hole expandability was evaluated based on the limiting hole expansion ratio.

Limiting hole expansion ratio: $\lambda(\%)=\{(D_f-D_0)/D_0\}\times100$ where $D_f$ is the hole diameter (mm) at the time of crack generation, and $D_0$ is the initial hole diameter (mm). In the disclosed embodiments, in the case where the hole expansion ratio (λ), which is an indicator of stretch-flange formability, was 30% or more, regardless of the strength of the steel sheet, the stretch-flange formability was evaluated as good.

Bend Test

A bend test was performed in accordance with JIS Z 2248. A strip test specimen with a width of 30 mm and a length of 100 mm was taken from the obtained steel sheet such that a direction parallel to the rolling direction of the steel sheet corresponded to the axial direction in the bend test. Then, a 90° V-bend test was performed under the conditions of an indentation load of 100 kN and a press holding time of 5 seconds. In the disclosed embodiments, bendability was evaluated on the basis of the pass rate of the bend test. At the maximum R in which the value R/t obtained by dividing the bend radius (R) by the thickness (t) was 5 or less (for example, when the thickness was 1.2 mm, the bend radius was 7.0 mm), five samples were subjected to the bend test. Next, the presence or absence of cracks on the ridge portion of the bend top was evaluated. In the case where all of the five samples did not crack, i.e., only in the case where the pass rate was 100%, bendability was evaluated as good. Here, the presence or absence of cracks was evaluated by measuring the ridge portion of the bend top with a digital microscope (RH-2000: manufactured by Hirox Co., Ltd.) at a magnification of 40 times.

Charpy Impact Test

A Charpy impact test was performed in accordance with JIS Z 2242. A test specimen having a width of 10 mm and a length of 55 mm and provided with a 90° V-notch with a notch depth of 2 mm at the center of the length was taken from the obtained steel sheet such that a direction perpendicular to the rolling direction of the steel sheet corresponded to the direction in which the V-notch was provided. Then, the Charpy impact test was performed in a test temperature range of −120 to +120° C. A transition curve was obtained from the resulting percent brittle fracture, and the temperature at which the percent brittle fracture was 50% was determined as the brittle-ductile transition temperature. In the disclosed embodiments, in the case where the brittle-ductile transition temperature obtained by the Charpy test was −40° C. or lower, toughness was evaluated as good.

Furthermore, in accordance with the methods described above, the area fractions of martensite and tempered martensite, the ratio of the carbon concentration in retained austenite to the volume fraction of retained austenite, the average grain size of martensite and tempered martensite, and the thickness of a surface softened layer were obtained. The remainder structure was also confirmed by structure observation.

The results are shown in Table 3.

TABLE 3

| No. | Steel grade | Area fraction of M (%) | Area fraction of TM (%) | Ratio of carbon concentration in retained austenite to volume fraction of retained austenite (—) | Average grain size of M and TM (μm) | Thickness of surface softened layer (μm) | Remainder structure | YS (MPa) |
|---|---|---|---|---|---|---|---|---|
| 1 | A | 77.9 | 18.6 | 0.16 | 3.1 | 52 | θ | 1123 |
| 2 | B | 76.9 | 17.3 | 0.10 | 2.6 | 36 | θ | 1333 |
| 3 | C | 63.0 | 30.4 | 0.13 | 4.8 | 48 | θ | 924 |
| 4 | C | 67.9 | 24.6 | 0.17 | 6.3 | 34 | θ | 895 |
| 5 | C | 82.5 | 2.6 | 0.16 | 4.0 | 42 | α + θ | 722 |
| 6 | C | 62.8 | 29.2 | 0.38 | 7.4 | 21 | θ | 839 |
| 7 | C | 70.1 | 22.8 | 0.04 | 3.6 | 48 | θ | 685 |
| 8 | C | 69.4 | 25.0 | 0.42 | 3.0 | 56 | θ | 1145 |
| 9 | C | 82.3 | 12.6 | 0.02 | 4.4 | 27 | θ | 686 |
| 10 | D | 68.7 | 24.9 | 0.22 | 2.2 | 51 | θ | 1512 |
| 11 | E | 70.2 | 20.6 | 0.14 | 5.2 | 48 | θ | 1265 |
| 12 | F | 78.6 | 18.3 | 0.14 | 2.7 | 25 | θ | 835 |
| 13 | G | 70.2 | 27.0 | 0.22 | 2.4 | 33 | θ | 946 |
| 14 | H | 65.7 | 29.1 | 0.13 | 3.8 | 32 | θ | 839 |
| 15 | I | 67.6 | 28.0 | 0.21 | 4.7 | 30 | θ | 879 |
| 16 | J | 84.2 | 11.5 | 0.13 | 5.0 | 17 | θ | 972 |
| 17 | K | 61.6 | 32.8 | 0.14 | 4.0 | 44 | θ | 1066 |
| 18 | L | 69.9 | 23.7 | 0.11 | 1.7 | 15 | θ | 1257 |
| 19 | M | 72.1 | 22.8 | 0.09 | 3.5 | 39 | θ | 952 |
| 20 | N | 85.2 | 5.0 | 0.26 | 3.7 | 36 | α + θ | 1274 |
| 21 | O | 76.2 | 15.7 | 0.28 | 4.9 | 24 | θ | 1073 |
| 22 | P | 62.2 | 32.0 | 0.23 | 3.1 | 56 | θ | 1143 |
| 23 | Q | 70.5 | 24.4 | 0.26 | 2.5 | 41 | θ | 1184 |
| 24 | R | 86.5 | 8.9 | 0.40 | 4.5 | 31 | θ | 1380 |
| 25 | S | 85.5 | 7.9 | 0.17 | 4.5 | 30 | θ | 1085 |
| 26 | T | 74.5 | 18.1 | 0.15 | 4.3 | 36 | θ | 1203 |
| 27 | U | 71.3 | 22.7 | 0.16 | 4.5 | 45 | θ | 951 |
| 28 | V | 66.9 | 28.3 | 0.20 | 4.6 | 48 | θ | 1551 |
| 29 | W | 62.9 | 29.3 | 0.07 | 3.2 | 50 | θ | 1010 |
| 30 | X | 75.7 | 16.8 | 0.28 | 3.1 | 20 | θ | 1011 |
| 31 | Y | 78.7 | 14.5 | 0.13 | 3.6 | 44 | θ | 892 |
| 32 | Z | 57.9 | 35.6 | 0.37 | 2.2 | 28 | θ | 1173 |
| 33 | Z | 62.2 | 21.3 | 0.37 | 2.4 | 13 | θ | 1204 |
| 34 | C | 61.2 | 34.4 | 0.37 | 3.9 | 60 | θ | 871 |
| 35 | Z | 66.3 | 29.4 | 0.37 | 3.4 | 12 | θ | 1281 |

| No. | TS (MPa) | YR (%) | λ (%) | Bendability | Toughness | Remarks |
|---|---|---|---|---|---|---|
| 1 | 1505 | 75 | 58 | Excellent | Excellent | Example |
| 2 | 1776 | 75 | 35 | Excellent | Excellent | Example |
| 3 | 1249 | 74 | 31 | Excellent | Excellent | Example |
| 4 | 1290 | 69 | 41 | Excellent | Poor | Comparative Example |
| 5 | 1245 | 58 | 14 | Excellent | Excellent | Comparative Example |
| 6 | 1233 | 68 | 47 | Excellent | Poor | Comparative Example |
| 7 | 1210 | 57 | 32 | Excellent | Excellent | Comparative Example |
| 8 | 1240 | 92 | 10 | Excellent | Excellent | Comparative Example |
| 9 | 1230 | 56 | 34 | Excellent | Excellent | Comparative Example |
| 10 | 2068 | 73 | 33 | Excellent | Excellent | Example |
| 11 | 1850 | 68 | 53 | Excellent | Excellent | Example |
| 12 | 1113 | 75 | 47 | Excellent | Excellent | Comparative Example |
| 13 | 1268 | 75 | 10 | Excellent | Excellent | Comparative Example |
| 14 | 1116 | 75 | 59 | Excellent | Excellent | Comparative Example |
| 15 | 1255 | 70 | 24 | Excellent | Excellent | Comparative Example |
| 16 | 1471 | 66 | 46 | Excellent | Excellent | Example |
| 17 | 1422 | 75 | 32 | Excellent | Excellent | Example |
| 18 | 1570 | 80 | 52 | Excellent | Excellent | Example |
| 19 | 1418 | 67 | 60 | Excellent | Excellent | Example |
| 20 | 1891 | 67 | 41 | Excellent | Excellent | Example |
| 21 | 1599 | 67 | 35 | Excellent | Excellent | Example |

TABLE 3-continued

| | | | | | | |
|---|---|---|---|---|---|---|
| 22 | 1518 | 75 | 53 | Excellent | Excellent | Example |
| 23 | 1806 | 66 | 39 | Excellent | Excellent | Example |
| 24 | 1851 | 75 | 43 | Excellent | Excellent | Example |
| 25 | 1540 | 70 | 46 | Excellent | Excellent | Example |
| 26 | 1598 | 75 | 49 | Excellent | Excellent | Example |
| 27 | 1358 | 70 | 55 | Excellent | Excellent | Example |
| 28 | 2072 | 75 | 54 | Excellent | Excellent | Example |
| 29 | 1550 | 65 | 59 | Excellent | Excellent | Example |
| 30 | 1446 | 70 | 51 | Excellent | Excellent | Example |
| 31 | 1187 | 75 | 59 | Excellent | Excellent | Example |
| 32 | 1483 | 79 | 41 | Excellent | Excellent | Example |
| 33 | 1503 | 80 | 37 | Excellent | Excellent | Example |
| 34 | 1183 | 74 | 42 | Excellent | Excellent | Example |
| 35 | 1568 | 82 | 30 | Excellent | Excellent | Example |

Underlined values: outside the scope of the disclosed embodiments.
M: martensite having a carbon concentration of more than 0.7 × [% C] and less than 1.5 × [% C]
TM: tempered martensite having a carbon concentration of 0.7 × [% C] or less
α: ferrite
θ: cementite As shown in Table 3, in Examples of the disclosed embodiments, TS is 1,180 MPa or more, and component dimensional accuracy, stretch-flange formability, bendability, and toughness are excellent. On the other hand, in Comparative Examples, any one or more of strength (TS), component dimensional accuracy (YR), stretch-flange formability (λ), bendability, and toughness is poor.

The invention claimed is:

1. A high-strength steel sheet having a tensile strength of 1,180 MPa or more, the high-strength steel sheet having a chemical composition comprising, by mass %:

C: 0.09% or more and 0.37% or less;
Si: more than 0.70% and 2.00% or less;
Mn: 2.60% or more and 3.60% or less;
P: 0.001% or more and 0.100% or less;
S: 0.0200% or less;
Al: 0.010% or more and 1.000% or less;
N: 0.0100% or less; and
the balance being Fe and incidental impurities, wherein the steel sheet has a steel structure in which an area fraction of martensite having a C concentration in a range of more than 0.7×[% C] and less than 1.5×[% C] is 55% or more, an area fraction of tempered martensite having a C concentration of 0.7×[% C] or less is in a range of 5% or more and 40% or less, a ratio of a C concentration in retained austenite to a volume fraction of retained austenite is in a range of 0.05 or more and 0.40 or less, and the martensite and the tempered martensite each have an average grain size of 5.3 μm or less, where [% C] represents the content, by mass %, of compositional element C in the steel sheet.

2. The high-strength steel sheet according to claim 1, wherein in the steel structure, a thickness of a surface softened layer is in a range of 10 μm or more and 100 μm or less.

3. The high-strength steel sheet according to claim 1, wherein the chemical composition further comprises, by mass %, at least one selected from the group consisting of:

Ti: 0.001% or more and 0.100% or less,
Nb: 0.001% or more and 0.100% or less,
V: 0.001% or more and 0.100% or less,
B: 0.0001% or more and 0.0100% or less,
Mo: 0.010% or more and 0.500% or less,
Cr: 0.01% or more and 1.00% or less,
Cu: 0.01% or more and 1.00% or less,
Ni: 0.01% or more and 0.50% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less.

4. The high-strength steel sheet according to claim 1, further comprising a coating layer disposed on a surface of the steel sheet.

5. A method for manufacturing the high-strength steel sheet according to claim 1, the method comprising annealing a cold-rolled steel sheet obtained by performing hot rolling, pickling, and cold rolling, wherein the annealing includes:

heating under conditions that an average heating rate in a temperature range of 250° C. or higher and 700° C. or lower is 10° C./s or more, and a heating temperature is in a range of 850° C. or higher and 950° C. or lower, and subsequently, cooling under conditions that a holding time in a temperature range of 50° C. or higher and 400° C. or lower is in a range of 70 s or more and 700 s or less, and an average cooling rate in a temperature range of 50° C. or higher and 250° C. or lower is 10.0° C./s or less.

6. The method for manufacturing the high-strength steel sheet according to claim 5, wherein, in the heating temperature range, an oxygen concentration is in a range of 2 ppm or more and 30 ppm or less, and a dew point is −35° C. or higher.

7. The method for manufacturing the high-strength steel sheet according to claim 5, further comprising, after the annealing, performing coating treatment.

8. The high-strength steel sheet according to claim 2, wherein the chemical composition further comprises, by mass %, at least one selected from the group consisting of:

Ti: 0.001% or more and 0.100% or less,
Nb: 0.001% or more and 0.100% or less,
V: 0.001% or more and 0.100% or less,
B: 0.0001% or more and 0.0100% or less,
Mo: 0.010% or more and 0.500% or less,
Cr: 0.01% or more and 1.00% or less,
Cu: 0.01% or more and 1.00% or less, Ni: 0.01% or more and 0.50% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less.

9. The high-strength steel sheet according to claim 2, further comprising a coating layer disposed on a surface of the steel sheet.

10. The high-strength steel sheet according to claim 3, further comprising a coating layer disposed on a surface of the steel sheet.

11. The high-strength steel sheet according to claim 8, further comprising a coating layer disposed on a surface of the steel sheet.

12. A method for manufacturing the high-strength steel sheet according to claim 2, the method comprising annealing a cold-rolled steel sheet obtained by performing hot rolling, pickling, and cold rolling, wherein the annealing includes:

heating under conditions that an average heating rate in a temperature range of 250° C. or higher and 700° C. or lower is 10° C./s or more, and a heating temperature is in a range of 850° C. or higher and 950° C. or lower, and subsequently, cooling under conditions that a holding time in a temperature range of 50° C. or higher and 400° C. or lower is in a range of 70 s or more and 700 s or less, and an average cooling rate in a temperature range of 50° C. or higher and 250° C. or lower is 10.0° C./s or less.

13. A method for manufacturing the high-strength steel sheet according to claim 3, the method comprising annealing a cold-rolled steel sheet obtained by performing hot rolling, pickling, and cold rolling, wherein the annealing includes:

heating under conditions that an average heating rate in a temperature range of 250° C. or higher and 700° C. or lower is 10° C./s or more, and a heating temperature is in a range of 850° C. or higher and 950° C. or lower, and subsequently, cooling under conditions that a holding time in a temperature range of 50° C. or higher and 400° C. or lower is in a range of 70 s or more and 700 s or less, and an average cooling rate in a temperature range of 50° C. or higher and 250° C. or lower is 10.0° C./s or less.

14. A method for manufacturing the high-strength steel sheet according to claim 8, the method comprising annealing a cold-rolled steel sheet obtained by performing hot rolling, pickling, and cold rolling, wherein the annealing includes:

heating under conditions that an average heating rate in a temperature range of 250° C. or higher and 700° C. or lower is 10° C./s or more, and a heating temperature is in a range of 850° C. or higher and 950° C. or lower, and subsequently, cooling under conditions that a holding time in a temperature range of 50° C. or higher and 400° C. or lower is in a range of 70 s or more and 700 s or less, and an average cooling rate in a temperature range of 50° C. or higher and 250° C. or lower is 10.0° C./s or less.

15. The method for manufacturing the high-strength steel sheet according to claim 12, wherein, in the heating temperature range, an oxygen concentration is in a range of 2 ppm or more and 30 ppm or less, and a dew point is −35° C. or higher.

16. The method for manufacturing the high-strength steel sheet according to claim 13, wherein, in the heating temperature range, an oxygen concentration is in a range of 2 ppm or more and 30 ppm or less, and a dew point is −35° C. or higher.

17. The method for manufacturing the high-strength steel sheet according to claim 14, wherein, in the heating temperature range, an oxygen concentration is in a range of 2 ppm or more and 30 ppm or less, and a dew point is −35° C. or higher.

18. The method for manufacturing the high-strength steel sheet according to claim 6, further comprising, after the annealing, performing coating treatment.

19. The method for manufacturing the high-strength steel sheet according to claim 12, further comprising, after the annealing, performing coating treatment.

20. The method for manufacturing the high-strength steel sheet according to claim 13, further comprising, after the annealing, performing coating treatment.

21. The method for manufacturing the high-strength steel sheet according to claim 14, further comprising, after the annealing, performing coating treatment.

22. The method for manufacturing the high-strength steel sheet according to claim 15, further comprising, after the annealing, performing coating treatment.

23. The method for manufacturing the high-strength steel sheet according to claim 16, further comprising, after the annealing, performing coating treatment.

24. The method for manufacturing the high-strength steel sheet according to claim 17, further comprising, after the annealing, performing coating treatment.

* * * * *